US008994481B2

(12) United States Patent
Ryu et al.

(10) Patent No.: US 8,994,481 B2
(45) Date of Patent: Mar. 31, 2015

(54) THIN FILM RESONATOR FOR WIRELESS POWER TRANSMISSION

(75) Inventors: Young Ho Ryu, Yongin-si (KR); Eun Seok Park, Suwon-si (KR); Sang Wook Kwon, Seongnam-si (KR); Young Tack Hong, Seongnam-si (KR); Nam Yun Kim, Seoul (KR); Jung Hae Lee, Seoul (KR); Jae Hyun Park, Seoul (KR); Byung Chul Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 398 days.

(21) Appl. No.: 12/967,195

(22) Filed: Dec. 14, 2010

(65) Prior Publication Data

US 2011/0140809 A1 Jun. 16, 2011

(30) Foreign Application Priority Data

Dec. 14, 2009 (KR) ..... 10-2009-0124267

(51) Int. Cl.
*H01P 7/00* (2006.01)
*H01P 7/08* (2006.01)
*H01P 7/02* (2006.01)

(52) U.S. Cl.
CPC ..... *H01P 7/082* (2013.01)
USPC ..... 333/219; 333/219.2

(58) Field of Classification Search
CPC ..... H01P 7/00; H01P 7/02; H01P 7/082
USPC ..... 333/219, 219.1, 219.2, 221, 223, 234, 333/235
See application file for complete search history.

(56) References Cited

U.S. PATENT DOCUMENTS

| | | | | |
|---|---|---|---|---|
| 6,420,820 | B1 | 7/2002 | Larson, III | |
| 6,456,861 | B1 * | 9/2002 | Hidaka et al. | 505/210 |
| 6,933,812 | B2 * | 8/2005 | Sarabandi et al. | 333/219 |
| 6,938,325 | B2 * | 9/2005 | Tanielian | 29/602.1 |
| 7,525,711 | B1 * | 4/2009 | Rule et al. | 359/244 |
| 8,174,341 | B2 * | 5/2012 | Lee et al. | 333/219 |
| 8,339,325 | B2 * | 12/2012 | Choi et al. | 343/753 |
| 8,558,644 | B2 * | 10/2013 | Ryu et al. | 333/219 |
| 8,576,026 | B2 * | 11/2013 | Liu et al. | 333/204 |
| 2005/0031295 | A1 | 2/2005 | Engheta et al. | |
| 2005/0146402 | A1 | 7/2005 | Sarabandi et al. | |
| 2013/0187475 | A1 * | 7/2013 | Vendik et al. | 307/104 |

FOREIGN PATENT DOCUMENTS

| | | |
|---|---|---|
| JP | 2003-249408 | 9/2003 |
| JP | 2006-101240 | 4/2006 |

OTHER PUBLICATIONS

Korean Office Action mailed Sep. 25, 2013 in the corresponding Korean Application No. 10-2009-0124267 (5 pages, in Korean).

* cited by examiner

*Primary Examiner* — Dean Takaoka
(74) *Attorney, Agent, or Firm* — NSIP Law

(57) ABSTRACT

A thin film resonator for a wireless power transmission is provided. The thin film resonator may include a first transmission line unit provided as a thin film type, a second transmission line unit also provided as the thin film type, and a capacitor inserted at a predetermined position of the first transmission line unit.

13 Claims, 7 Drawing Sheets

THIN FILM RESONATOR FOR WIRELESS POWER TRANSMISSION

CROSS-REFERENCE TO RELATED APPLICATION(S)

This application claims the benefit under 35 U.S.C. §119 (a) of Korean Patent Application No. 10-2009-0124267, filed on Dec. 14, 2009, in the Korean Intellectual Property Office, the entire disclosure of which is incorporated herein by reference for all purposes.

BACKGROUND

1. Field

The following description relates to a wireless power transmission system, and more particularly, to a thin film resonator for wireless power transmission.

2. Description of Related Art

Recently, techniques for wireless power transmission are attracting an increasing amount of attention. Particularly, it would be favorable to supply power wirelessly to various types of mobile devices such as a cell phone, a laptop computer, an MP3 player, and the like. One technique for wireless power transmission includes the use of a resonance characteristic of a radio frequency (RF) device.

A wireless power transmission system using the resonance characteristic may include a source to supply power and a destination to receive the power. In this example, when the destination is a mobile device, the source and the destination may be located close to each other. Therefore, in the wireless power transmission system including a resonator, the resonator needs to have a short power transmission length. In order to provide the short power transmission length, the resonator may have a large form factor.

A physical size of the resonator for the wireless power transmission with the large form factor may be relatively large and the power transmission efficiency may be relatively low. In a general resonator for the wireless power transmission, a resonance frequency may depend on the physical size of the resonator. This may be a barrier for reducing the size of the resonator for the wireless power transmission.

SUMMARY

In one general aspect, there is provided a resonator for a wireless power transmission, the resonator comprising a first transmission line unit provided as a thin film type, a second transmission line unit provided as the thin film type, and a capacitor that is inserted at a predetermined position of the first transmission line unit.

The capacitor may be configured such that the thin film resonator has a property of a metamaterial.

The capacitor may be configured such that the thin film resonator has a zero magnetic permeability or a negative magnetic permeability at a target frequency.

The first transmission line unit and the second transmission line unit may be configured to form a stacked structure.

The stacked structure of the first transmission line unit and the second transmission line unit may comprise a ferromagnetic substance or a magneto-dielectric structure.

The resonator may further comprise a micro-strip line to supply an electric current to the first transmission line unit.

The resonator may further comprise a bonding layer to bond the resonator to an object.

In one general aspect, there is provided a resonator for a wireless power transmission, the resonator comprising a transmission line unit provided as a thin film type, a second transmission line unit provided as the thin film type, an opening between the firs transmission line unit and the second transmission line unit, and a capacitor inserted in the opening between the first transmission line unit and the second transmission line unit.

The first transmission line unit may comprise one or more vias disposed near the opening and the second transmission line unit may comprise one or more vias disposed near the opening.

Other features and aspects may be apparent from the following description, the drawings, and the claims.

BRIEF DESCRIPTION OF THE DRAWINGS

Throughout the drawings and the description, unless otherwise described, the same drawing reference numerals should be understood to refer to the same elements, features, and structures. The relative size and depiction of these elements may be exaggerated for clarity, illustration, and convenience.

DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein may be suggested to those of ordinary skill in the art. Also, description of well-known functions and constructions may be omitted for increased clarity and conciseness.

As described herein, for example, the transmitter may be, or may be included in, a terminal, such as a mobile terminal, a personal computer, a personal digital assistant (PDA), an MP3 player, and the like. As another example, the receiver described herein may be, or may be included in, a terminal, such as a mobile terminal, a personal computer, a personal digital assistant (PDA), an MP3 player, and the like. As another example, the transmitter and/or the receiver may be a separate individual unit.

Figure 1:
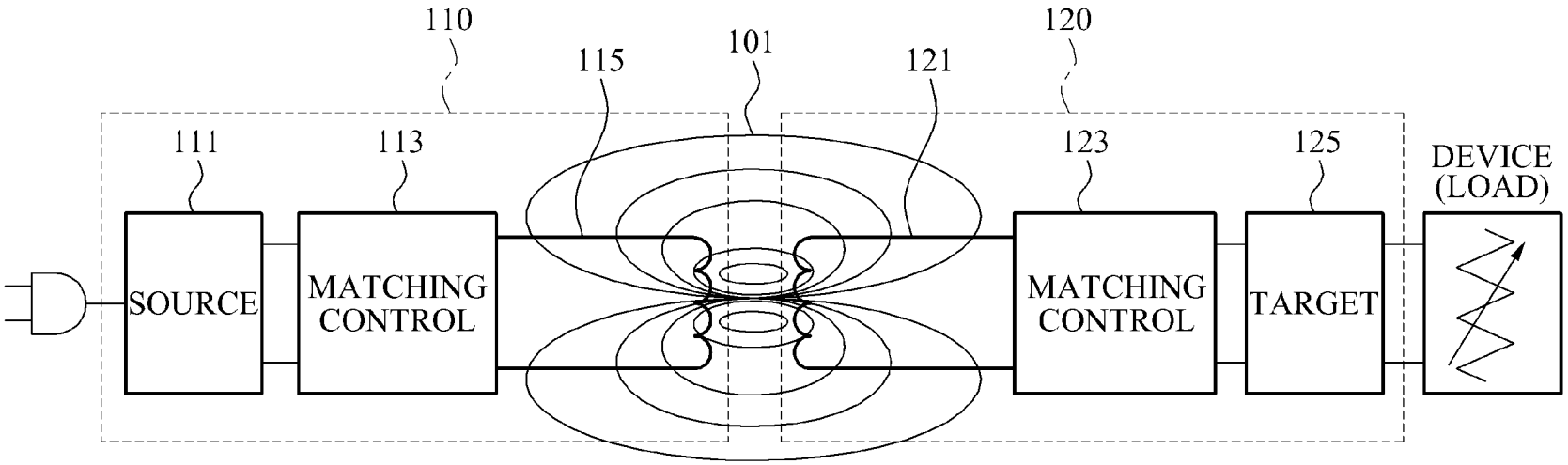
FIG. 1 is a diagram illustrating an example of a wireless power transmission system.

FIG. 1 illustrates an example of a wireless power transmission system.

For example, wireless power transmitted using the wireless power transmission system may be referred to as resonance power.

Referring to FIG. 1, the wireless power transmission system includes a source-target structure including a source and a target. In this example, the wireless power transmission system includes a resonance power transmitter 110 corresponding to the source and a resonance power receiver 120 corresponding to the target.

The resonance power transmitter 110 includes a source unit 111 and a source resonator 115. The source unit 111 may receive energy from an external voltage supplier to generate a resonance power. The resonance power transmitter 110 may further include a matching control 113 to perform resonance frequency or impedance matching.

For example, the source unit 111 may include an alternating current (AC)-to-AC (AC/AC) converter, an AC-to-direct current (DC) (AC/DC) converter, and a (DC/AC) inverter. The AC/AC converter may adjust, to a desired level, a signal level of an AC signal input from an external device. The AC/DC converter may output a DC voltage at a predetermined level by rectifying an AC signal output from the AC/AC converter. The DC/AC inverter may generate an AC signal frequency of, for example, a few megahertz (MHz) band, tens of MHz band, and the like, by quickly switching a DC voltage output from the AC/DC converter.

The matching control 113 may set at least one of a resonance bandwidth of the source resonator 115 and an impedance matching frequency of the source resonator 115. Although not illustrated in FIG. 1, the matching control 113 may include at least one of a source resonance bandwidth setting unit and a source matching frequency setting unit. The source resonance bandwidth setting unit may set the resonance bandwidth of the source resonator 115. The source matching frequency setting unit may set the impedance matching frequency of the source resonator 115. For example, a Q-factor of the source resonator 115 may be determined based on the setting of the resonance bandwidth of the source resonator 115 and/or the setting of the impedance matching frequency of the source resonator 115.

The source resonator 115 may transfer electromagnetic energy to a target resonator 121. For example, the source resonator 115 may transfer the resonance power to the resonance power receiver 120 through magnetic coupling 101 with a target resonator 121. The source resonator 115 may resonate within the set resonance bandwidth.

The resonance power receiver 120 includes the target resonator 121, a matching control 123 to perform resonance frequency or impedance matching, and a target unit 125 to transfer the received resonance power to a load.

The target resonator 121 may receive the electromagnetic energy from the source resonator 115. The target resonator 121 may resonate within the set resonance bandwidth.

For example, the matching control 123 may set at least one of a resonance bandwidth of the target resonator 121 and an impedance matching frequency of the target resonator 121. Although not illustrated in FIG. 1, the matching control 123 may include at least one of a target resonance bandwidth setting unit and a target matching frequency setting unit. The target resonance bandwidth setting unit may set the resonance bandwidth of the target resonator 121. The target matching frequency setting unit may set the impedance matching frequency of the target resonator 121. For example, a Q-factor of the target resonator 121 may be determined based on the setting of the resonance bandwidth of the target resonator 121 and/or the setting of the impedance matching frequency of the target resonator 121.

The target unit 125 may transfer the received resonance power to the load. For example, the target unit 125 may include an AC/DC converter and a DC/DC converter. The AC/DC converter may generate a DC voltage by rectifying an AC signal transmitted from the source resonator 115 to the target resonator 121. The DC/DC converter may supply a rated voltage to a device or a load by adjusting a voltage level of the DC voltage.

For example, the source resonator 115 and the target resonator 121 may be configured in a helix coil structured resonator, a spiral coil structured resonator, a meta-structured resonator, and the like.

Referring to FIG. 1, a process of controlling the Q-factor may include setting the resonance bandwidth of the source resonator 115 and the resonance bandwidth of the target resonator 121, and transferring the electromagnetic energy from the source resonator 115 to the target resonator 121 through magnetic coupling 101 between the source resonator 115 and the target resonator 121. For example, the resonance bandwidth of the source resonator 115 may be set wider or narrower than the resonance bandwidth of the target resonator 121. For example, an unbalanced relationship between a bandwidth (BW)-factor of the source resonator 115 and a BW-factor of the target resonator 121 may be maintained by setting the resonance bandwidth of the source resonator 115 to be wider or narrower than the resonance bandwidth of the target resonator 121.

In a wireless power transmission system employing a resonance scheme, the resonance bandwidth may be an important factor. When the Q-factor considering a change in a distance between the source resonator 115 and the target resonator 121, a change in the resonance impedance, impedance mismatching, a reflected signal, and the like, is Qt, Qt may have an inverse-proportional relationship with the resonance bandwidth, as given by Equation 1.

$$\frac{\Delta f}{f_0} = \frac{1}{Qt} = \Gamma_{S,D} + \frac{1}{BW_S} + \frac{1}{BW_D} \quad \text{[Equation 1]}$$

In Equation 1, $f_0$ denotes a central frequency, $\Delta f$ denotes a change in bandwidth, $\Gamma_{S,D}$ denotes a reflection loss between the source resonator 115 and the target resonator 121, $BW_s$ denotes the resonance bandwidth of the source resonator 115, and $BW_D$ denotes the resonance bandwidth of the target resonator 121. For example, the BW-factor may indicate either $1/BW_s$ or $1/BW_D$.

Due to an external effect, impedance mismatching between the source resonator 115 and the target resonator 121 may occur. For example, a change in the distance between the source resonator 115 and the target resonator 121, a change in a location of at least one of the source resonator 115 and the target resonator 121, and the like, may cause impedance mismatching between the source resonator 115 and the target resonator 121 to occur. The impedance mismatching may be a direct cause in decreasing an efficiency of power transfer.

When a reflected wave corresponding to a transmission signal that is partially reflected by the target and returned towards the source is detected, the matching control 113 may determine that impedance mismatching has occurred, and may perform impedance matching. For example, the matching control 113 may change a resonance frequency by detecting a resonance point through a waveform analysis of the reflected wave. The matching control 113 may determine, as the resonance frequency, a frequency having a minimum amplitude in the waveform of the reflected wave.

Figure 2:
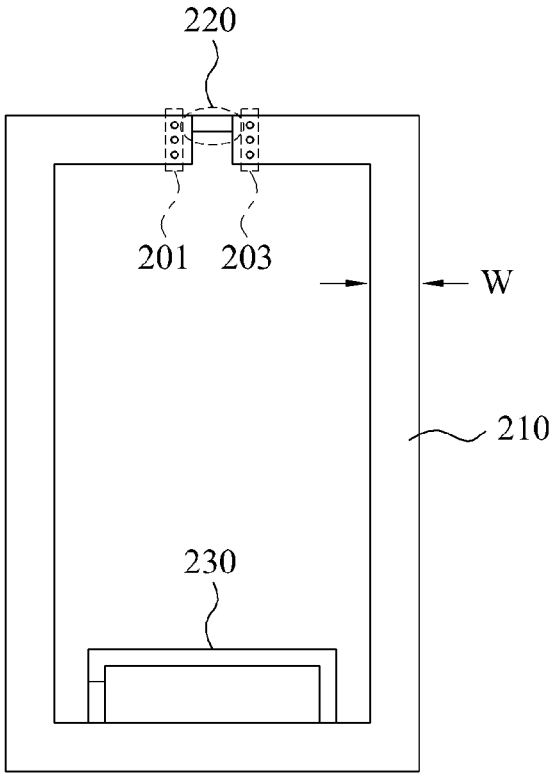
FIG. 2 is a diagram illustrating an example of a thin film resonator for wireless power transmission.

FIG. 2 illustrates an example of a thin film resonator for wireless power transmission.

Referring to FIG. 2, the thin film resonator for wireless power transmission includes a transmission line unit 210 and a capacitor 220. The resonator may further include a feeding unit 230.

Figure 3:
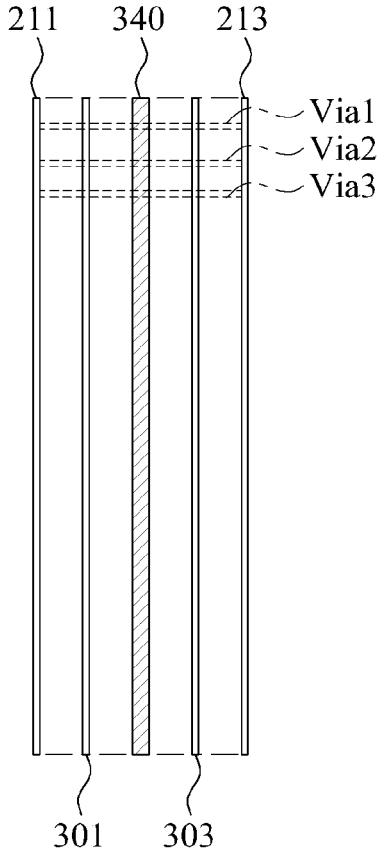
FIG. 3 is a side view illustrating an example of a thin film resonator.

The transmission line unit 210 may be provided in a thin film type, and may form a stacked structure for a strong magnetic field coupling. By forming vias at both ends 201 and 203 of the transmission line unit 210 including the capacitor 220, the transmission line unit 210 may be configured in a stacked structure. For example, a via may be a hole, a trench, an opening, and the like. The stacked structure is further described referring to FIG. 3. Referring to FIG. 3, the transmission line unit 210 may include a first transmission line unit 211 provided as a thin film type and a second transmission line unit 213 provided as a thin film type.

The capacitor 220 may be inserted into a predetermined position of the first transmission line unit 211. For example, the capacitor 220 may be inserted in series into any portion of the first transmission line unit 211. An electric field generated in the resonator may be confined within the capacitor 220.

The capacitor 220 may be inserted into the first transmission line unit 211 in the shape of a lumped element and a distributed element, for example, in the shape of an interdigital capacitor or a gap capacitor with a substrate that has a relatively high permittivity in the middle. As the capacitor 220 is inserted into the first transmission line unit 211, the resonator may have a property of a metamaterial.

The metamaterial indicates a material having a predetermined electrical property that has not been discovered in nature, and thus, may have an artificially designed structure. An electromagnetic characteristic of the materials existing in nature may have a unique magnetic permeability or a unique permittivity. Most materials may have a positive magnetic permeability or a positive permittivity. In the case of most materials, a right hand rule may be applied to an electric field, a magnetic field, and a pointing vector, and thus, the corresponding materials may be referred to as right handed materials (RHMs). However, a metamaterial has a magnetic permeability or a permittivity less than "1," and thus, may be classified into an epsilon negative (ENG) material, a mu negative (MNG) material, a double negative (DNG) material, a negative refractive index (NRI) material, a left-handed (LH) material, and the like, based on a sign of the corresponding permittivity or magnetic permeability.

When a capacitance of the capacitor 220 inserted as the lumped element is appropriately determined, the resonator may have the characteristic of a metamaterial. Because the resonator may have a zero or negative magnetic permeability by adjusting the capacitance of the capacitor 220, the resonator may be referred to as an MNG resonator provided as a thin film type.

The MNG resonator of the thin film type may have a zeroth order resonance characteristic that has, as a resonance frequency, a frequency when a propagation constant is "0". For example, a zeroth order resonance characteristic may be a frequency transmitted through a line or a medium that has a propagation constant of "0." Because the MNG resonator of the thin film type may have the zeroth order resonance characteristic, the resonance frequency may be independent with respect to a physical size of the MNG resonator of the thin film type. By appropriately designing the capacitor 220, the MNG resonator of the thin film type may sufficiently change the resonance frequency. Accordingly, the physical size of the MNG resonator of the thin film type may does not need to be changed.

In a near field, the electric field may be concentrated on the series capacitor 220 inserted into the first transmission line unit 211. Accordingly, due to the series capacitor 220, the magnetic field may become dominant in the near field.

The MNG resonator of the thin film type may have a relatively high Q-factor using the capacitor 220 of the lumped element, and thus, it is possible to enhance an efficiency of power transmission.

The feeding unit 230 may be configured in the shape of a micro-strip line that supplies current to the first transmission line unit 211. Accordingly, the thin film resonator may have a structure in which a matcher for impedance matching is not needed.

FIG. 3 illustrates an example of a thin film resonator.

Figure 4:
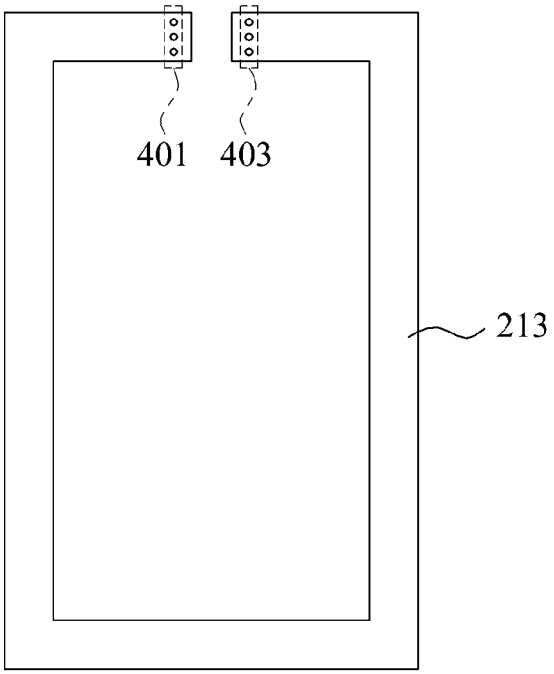
FIG. 4 is a front view illustrating an example of a second transmission line unit.

Referring to FIG. 3, the thin film resonator may be configured in a stacked structure to induce a strong magnetic coupling. A second transmission line unit 213 may be stacked on a first transmission line unit 211 such that the strong magnetic coupling is induced. As shown in FIG. 3, the thin film resonator may be configured in a stacked structure through a via 1, a via 2, and a via 3. The stacked structure may further include a plurality of layers of conducting layers 301 and 303. For example, referring to FIG. 4, the second transmission line unit 213 does not have the same structure as a structure of the first transmission line unit 211. Referring to FIG. 4, for example, the second transmission line unit 213 may include a via for the stacked structure at both ends 401 and 403.

The thin film resonator may include a dielectric material layer 340 between the first transmission line unit 211 and the second transmission line unit 213. For example, the dielectric material layer 340 may be designed so that a magnetic field of the thin film resonator is increased. For example, the dielectric material layer 340 may include a ferromagnetic substance or a magneto-dielectric structure. The ferromagnetic substance or the magneto-dielectric structure may increase a wireless power transmission effect.

A thin film resonator may be configured in various types.

Figure 5:
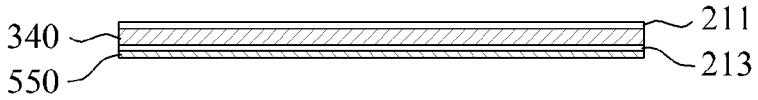
FIG. 5 and FIG. 6 are diagrams illustrating examples of a thin film resonator.
Figure 6:
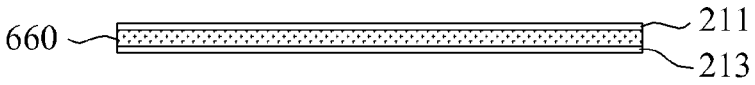

FIG. 5 and FIG. 6 illustrate examples of a thin film resonator.

Referring to FIG. 5, the thin film resonator includes a first transmission line unit 211, a second transmission line unit 213, a capacitor 340, and a bonding layer 550.

The bonding layer 550 may include a material that may bond the thin film resonator to an object. For example, the thin film resonator may be attached to a cover of a portable device.

Referring to FIG. 6, the thin film resonator includes a first transmission line unit 211, a second transmission line unit 213, and a substrate layer 660. For example, the substrate layer 660 may be a printed circuit board (PCB) with which a portable device is equipped. For example, the thin film resonator of FIG. 6 may be incorporated in a portable device.

Figure 7:
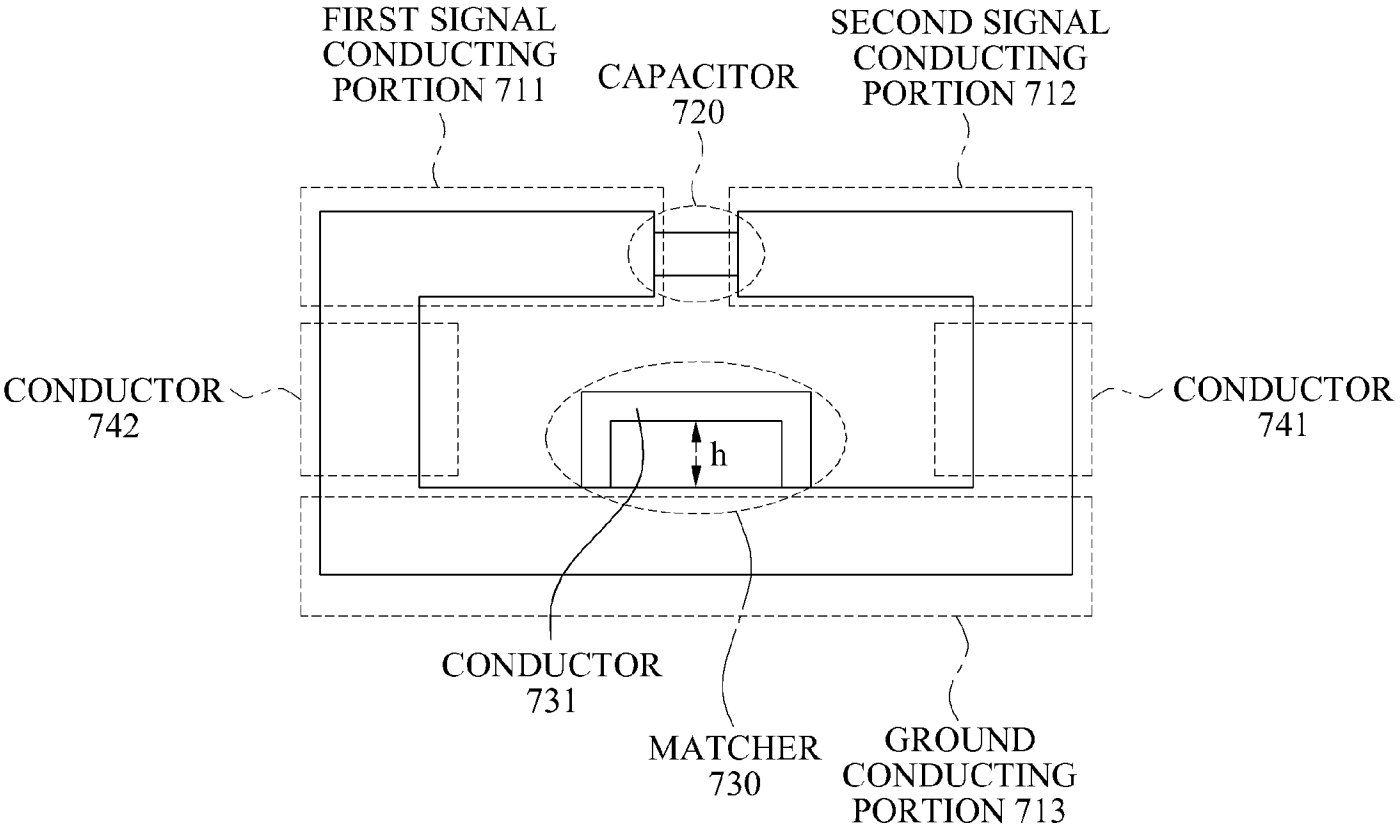
FIG. 7 is a diagram illustrating an example of a first transmission line unit that may be included in the thin film resonator of FIG. 2.

FIG. 7 illustrates an example of a first transmission line unit that may be included in the thin film resonator of FIG. 2

Referring to FIG. 7, the first transmission line unit 700 includes a transmission line, a capacitor 720, a matcher 730, and conductors 741 and 742. The transmission line may include a first signal conducting portion 711, a second signal conducting portion 712, and a ground conducting portion 713.

For example, the capacitor 720 may be inserted in series between the first signal conducting portion 711 and the second signal conducting portion 712, and an electric field may be confined within the capacitor 720. Generally, the transmission line may include at least one conductor in an upper portion of the transmission line, and may also include at least one conductor in a lower portion of the transmission line. Current may flow through the at least one conductor disposed in the upper portion of the transmission line, and the at least one conductor disposed in the lower portion of the transmission may be electrically grounded. For example, a conductor disposed in an upper portion of the transmission line may be separated into and referred to as the first signal conducting portion 711 and the second signal conducting portion 712. A conductor disposed in the lower portion of the transmission line may be referred to as the ground conducting portion 713.

As shown in FIG. 7, the first transmission line unit 700 may have a two-dimensional (2D) structure. For example, the transmission line may include the first signal conducting portion 711 and the second signal conducting portion 712 in the upper portion of the transmission line, and may include the ground conducting portion 713 in the lower portion of the transmission line. The first signal conducting portion 711 and the second signal conducting portion 712 may be disposed to face the ground conducting portion 713. Current may flow through the first signal conducting portion 711 and the second signal conducting portion 712.

One end of the first signal conducting portion 711 may be shorted to the conductor 742, and another end of the first signal conducting portion 711 may be connected to the capacitor 720. One end of the second signal conducting portion 712 may be grounded to the conductor 741, and another end of the second signal conducting portion 712 may be connected to the capacitor 720. Accordingly, the first signal conducting portion 711, the second signal conducting portion 712, the ground conducting portion 713, and the conductors 741 and 742 may be connected to each other such that the first transmission line unit 700 has an electrically closed-loop structure. The term "loop structure" may include a polygonal structure, for example, a circular structure, a rectangular structure, and the like. "Having a loop structure" may indicate a circuit that is electrically closed.

The capacitor 720 may be inserted into an intermediate portion of the transmission line. For example, the capacitor 720 may be inserted into a space between the first signal conducting portion 711 and the second signal conducting portion 712. The capacitor 720 may have a shape of a lumped element, a distributed element, and the like. For example, a distributed capacitor that has the shape of the distributed element may include zigzagged conductor lines and a dielectric material that has a relatively high permittivity between the zigzagged conductor lines.

When the capacitor 720 is inserted into the transmission line, the first transmission line unit 700 may have the property of a metamaterial. The metamaterial indicates a material having a predetermined electrical property that has not been discovered in nature and thus, may have an artificially designed structure. When a capacitance of the capacitor inserted as the lumped element is appropriately determined, the first transmission line unit 700 may have the characteristic of the metamaterial. Because the first transmission line unit 700 may have a negative magnetic permeability by adjusting the capacitance of the capacitor 720, the first transmission line unit 700 may also be referred to as an MNG resonator. Various criteria may be applied to determine the capacitance of the capacitor 720. For example, the various criteria may include a criterion for enabling the first transmission line unit 700 to have the characteristic of the metamaterial, a criterion for enabling the first transmission line unit 700 to have a negative magnetic permeability in a target frequency, a criterion for enabling the first transmission line unit 700 to have a zeroth order resonance characteristic in the target frequency, and the like. For example, the capacitance of the capacitor 720 may be determined based on at least one criterion.

The first transmission line unit 700, also referred to as the MNG first transmission line unit 700, may have a zeroth order resonance characteristic that has, as a resonance frequency, a frequency when a propagation constant is "0". Because the first transmission line unit 700 may have the zeroth order resonance characteristic, the resonance frequency may be independent with respect to a physical size of the MNG first transmission line unit 700. By appropriately designing the capacitor 720, the MNG first transmission line unit 700 may sufficiently change the resonance frequency. Accordingly, the physical size of the MNG first transmission line unit 700 does not need to be changed.

In a near field, the electric field may be concentrated on the capacitor 720 inserted into the transmission line. Because of the capacitor 720, the magnetic field may become dominant in the near field. The MNG first transmission line unit 700 may have a relatively high Q-factor using the capacitor 720 of the lumped element, and thus, it is possible to enhance an efficiency of power transmission. For example, the Q-factor may indicate a level of an ohmic loss or a ratio of a reactance with respect to a resistance in the wireless power transmission. It should be understood that the efficiency of the wireless power transmission may increase based on an increase in the Q-factor.

The MNG first transmission line unit 700 may include the matcher 730 for impedance matching. The matcher 730 may adjust a strength of a magnetic field of the MNG first transmission line unit 700. An impedance of the MNG first transmission line unit 700 may be determined by the matcher 730. Current may flow into and/or out of the MNG first transmission line unit 700 via a connector. For example, the connector may be connected to the ground conducting portion 713 or the matcher 730. The power may be transferred through coupling without using a physical connection between the connector 740 and the ground conducting portion 713 or the matcher 730.

For example, as shown in FIG. 7, the matcher 730 may be positioned within the loop to formed by the loop structure of the first transmission line unit 700. The matcher 730 may adjust the impedance of the first transmission line unit 700 by changing the physical shape of the matcher 730. For example, the matcher 730 may include the conductor 731 for the impedance matching in a location that is separated from the ground conducting portion 713 by a distance h. The impedance of the first transmission line unit 700 may be changed by adjusting the distance h.

Although not illustrated in FIG. 7, a controller may be provided to control the matcher 730. In this example, the matcher 730 may change the physical shape of the matcher 730 based on a control signal generated by the controller. For example, the distance h between the conductor 731 of the matcher 730 and the ground conducting portion 713 may increase or decrease based on the control signal. Accordingly, the physical shape of the matcher 730 may be changed and the impedance of the first transmission line unit 700 may be adjusted. The controller may generate the control signal based on various factors.

As shown in FIG. 7, the matcher 730 may be configured as a passive element such as the conductor 731. As another example, the matcher 730 may be configured as an active element such as a diode, a transistor, and the like. When the active element is included in the matcher 730, the active element may be driven based on the control signal generated by the controller, and the impedance of the first transmission line unit 700 may be adjusted based on the control signal. For example, a diode that is a type of the active element may be included in the matcher 730. The impedance of the first transmission line unit 700 may be adjusted based on whether the diode is in an ON state or in an OFF state.

Although a thin film resonator having a stacked structure with two layers is described, it should be appreciated that the thin film resonator may have a stacked structure with three or more layers. In the example of the stacked structure with three layers, while the resonator may be thicker, a transmission efficiency may increase because of an increased coupling of a magnetic field.

According to various examples, provided is an MNG resonator of a thin film type in which a resonance frequency does not depend on the size of the resonator.

According to various examples, provided is a thin film resonator in which an impedance matching circuit is not necessarily needed.

According to various examples, provided is a thin film resonator that is easy to carry and miniaturize, which may minimize a conductor loss, and which may increase a transmission efficiency.

The processes, functions, methods, and/or software described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. Examples of computer-readable storage media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

As a non-exhaustive illustration only, the terminal device described herein may refer to mobile devices such as a cellular phone, a personal digital assistant (PDA), a digital camera, a portable game console, an MP3 player, a portable/personal multimedia player (PMP), a handheld e-book, a portable laptop personal computer (PC), a global positioning system (GPS) navigation, and devices such as a desktop PC, a high definition television (HDTV), an optical disc player, a setup box, and the like, capable of wireless communication or network communication consistent with that disclosed herein.

A computing system or a computer may include a microprocessor that is electrically connected with a bus, a user interface, and a memory controller. It may further include a flash memory device. The flash memory device may store N-bit data via the memory controller. The N-bit data is processed or will be processed by the microprocessor and N may be 1 or an integer greater than 1. Where the computing system or computer is a mobile apparatus, a battery may be additionally provided to supply operation voltage of the computing system or computer.

It should be apparent to those of ordinary skill in the art that the computing system or computer may further include an application chipset, a camera image processor (CIS), a mobile Dynamic Random Access Memory (DRAM), and the like. The memory controller and the flash memory device may constitute a solid state drive/disk (SSD) that uses a non-volatile memory to store data.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A resonator for wireless power transmission, the resonator comprising:

a first transmission line unit provided as a thin film type and comprising two end portions forming a gap between the end portions;

a second transmission line unit provided as the thin film type, and comprising two ends portions forming a gap between the end portions; and a capacitor that is disposed between the two end portions of the first transmission line unit, wherein the first and second transmission line units are electrically connected in parallel through the end portions of the first transmission line unit and the end portions of the second transmission line unit.

2. The resonator of claim 1, wherein the capacitor is configured such that the resonator has a property of a metamaterial.

3. The resonator of claim 1, wherein the capacitor is configured such that the resonator has a zero magnetic permeability or a negative magnetic permeability at a target frequency.

4. The resonator of claim 1, wherein the first transmission line unit and the second transmission line unit are configured to form a stacked structure.

5. The resonator of claim 4, wherein the stacked structure of the first transmission line unit and the second transmission line unit comprises a ferromagnetic substance or a magneto-dielectric structure.

6. The resonator of claim 1, further comprising:

a micro-strip line to supply an electric current to the first transmission line unit.

7. The resonator of claim 1, further comprising:

a bonding layer disposed on a surface of the resonator, and configured to bond the resonator to an object.

8. The resonator of claim 1, wherein the two end portions of each of the first transmission line unit and the second transmission line unit comprise a hole.

9. The resonator of claim 1, wherein the gap of the second transmission line unit remains open.

10. The resonator of claim 1, further comprising:

a dielectric material layer disposed between the first transmission line unit and the second transmission line unit, and conductive layers formed between the first transmission line unit and the dielectric material layer and between the second transmission lint unit and the dielectric material layer, respectively.

11. The resonator of claim 1, further comprising a dielectric material layer disposed between and directly contacting the first and second transmission line units.

12. A resonator for wireless power transmission, the resonator comprising:

a first transmission line unit provided as a thin film type and having a gap between portions of the first transmission line;

a second transmission line unit provided as the thin film type, electrically connected in parallel to the first transmission unit, and comprising two end portions forming a gap between the end portions;

a space between laminations of the first transmission line unit and the second transmission line unit; and a capacitor inserted in the gap between the portions of the first transmission line unit and electrically connected in series with the portions of the first transmission line.

13. The resonator of claim 12, wherein the first transmission line unit comprises one or more vias that electrically interconnect the first and second transmission line units.

* * * * *